United States Patent [19]

Keiser

[11] Patent Number: 4,945,362

[45] Date of Patent: Jul. 31, 1990

[54] MICROWAVE SHIELDING FOR SATELLITE EARTH STATIONS

[75] Inventor: Bernhard E. Keiser, Vienna, Va.

[73] Assignee: The Reinforced Earth Company, Arlington, Va.

[21] Appl. No.: 714,093

[22] Filed: Mar. 20, 1985

[51] Int. Cl.[5] ..... H01Q 15/14

[52] U.S. Cl. ..... 343/841; 343/912; 343/753

[58] Field of Search ..... 343/841, 911, 912, 753; 174/35 MS

[56] References Cited

U.S. PATENT DOCUMENTS

| | | | |
|---|---|---|---|
| 2,594,871 | 4/1952 | Chu et al. | 343/780 |
| 2,936,453 | 5/1960 | Coleman | 343/915 |
| 3,300,268 | 1/1967 | Straub | 343/840 |
| 3,314,071 | 4/1967 | Lader et al. | 343/912 |
| 3,427,625 | 2/1969 | Kazimi | 343/912 |
| 3,495,265 | 2/1974 | Smith | 343/911 |
| 3,683,394 | 8/1982 | Smith | 343/841 |
| 3,732,653 | 5/1973 | Pickett | 52/71 |
| 3,733,609 | 5/1973 | Bartlett | 343/782 |
| 3,790,949 | 2/1974 | McGraw | 343/912 |
| 3,982,249 | 9/1976 | Toman | 343/841 |
| 4,242,686 | 12/1980 | Macturk | 343/873 |
| 4,249,183 | 2/1981 | Bui Hai | 343/781 R |
| 4,342,033 | 7/1986 | Camargo | 343/909 |
| 4,474,676 | 10/1984 | Ishino et al. | 174/35 MS |
| 4,513,293 | 4/1985 | Stephens | 343/840 |
| 4,568,945 | 2/1986 | Winegard | 343/916 |
| 4,608,453 | 8/1986 | Freeman | 174/35 MS |
| 4,651,160 | 3/1987 | Bornkast et al. | 343/914 |

FOREIGN PATENT DOCUMENTS

| | | |
|---|---|---|
| 643002 | 6/1962 | Canada . |
| 825665 | 3/1938 | France . |

OTHER PUBLICATIONS

Fanwall Drawing 11016-A (Exhibit A), Mar. 1, 1982 Titled "Fanwall Barrier Layout Details".

Fanwall Drawing 11016 (Exhibit B), Feb. 17, 1982 Titled "Fanwell Panel Details".

Price, et al., "Transmission Loss Predictions for Tropospheric Communication Circuits", National Bureau of Standards Technical Note 101, as revised Jan. 1, 1967.

McCue, "Remarks on Anti-RFI Fences", IEEE Transactions on Electromagnetic Compatability, vol. EM-C-23, No. 1, pp. 28-32, Feb. 1, 1981.

Becker, et al., "A Double-Slot Radar Fence for Increased Clutter Supression", IEEE Transactions on Antennas and Propagation, vol. AP-16, No. 1, pp. 103-108, Jan. 1968.

Becker, et al., "Control of Radar Site Environment by Use of Fences", IEEE Transactions on Antennas and Propagation, vol. AP-14, No. 6, pp. 768-773, Nov. 1966.

(List continued on next page.)

*Primary Examiner*—Rolf Hille

*Assistant Examiner*—Michael C. Wimer

*Attorney, Agent, or Firm*—Allegretti & Witcoff, Ltd.

[57] ABSTRACT

A construction for shielding an item against interference from a microwave radio frequency radiation is disclosed, having a wall structure adapted to minimize radio frequency interference in the vicinity of an antenna. The wall is composed of a plurality of modular wall panels, each having a layer of electrically conductive materials that substantially reflects interfering electromagnetic microwave signals. The wall structure includes a top construction creating a thin, horizontal gap in the conductive material at the wall's top that acts to control diffraction over the wall. In the preferred embodiment, the layer of electrically conductive material is a mesh of expanded metal embedded in the wall modules. The gap comprises the space between the top of the mesh and a pair of vertically adjustable metal strips mounted on the wall. In the preferred embodiment, the wall panels are precast concrete that may be horizontally positioned with a joint allowing up to 180° of relative movement.

3 Claims, 5 Drawing Sheets

OTHER PUBLICATIONS

Ruze, et al., "Radar Ground-Clutter Shields", Proceedings of the IEEE, vol. 54, No. 9, pp. 1171-1183, Sep. 1966.

Takada, et al., "An Application of the Diffractor Grating to the 11-Gc/s Microwave Systems", IEEE Transactions on Antennas and Propagation, vol. AP-13, No. 4, pp. 532-541, Jul. 1965.

Preikschat, "Screening Fences for Ground Reflection Reduction", The Microwave Journal, pp. 46-50, Aug. 1964.

Waite, et al., "Diffraction of Electromagnetic Waves by Smooth Obstacles for Grazing Angles", Journal of Research of the National Bureau of Standards-D. Radio Propagation, vol. 63D, pp. 181-197, Sep.-Oct. 1959.

Fanwall Brochure: "RF Interference Shield", 1983.

Telecommunications brochure: "Shielding Earth Stations from RF Interference, use of Barrier Walls".

Fig. 5
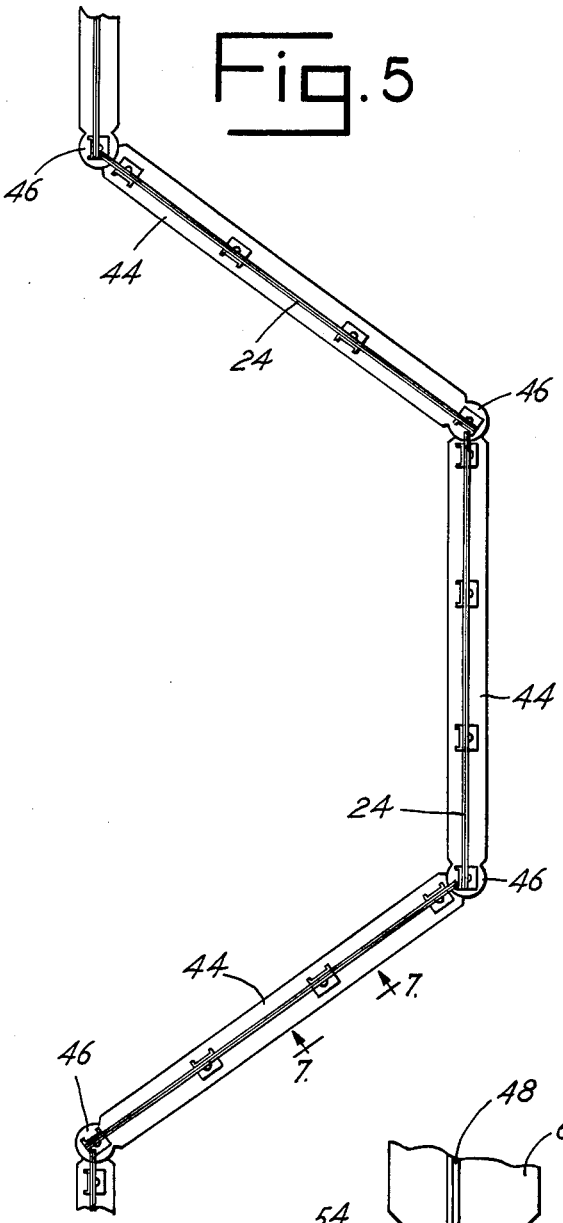
Fig. 7
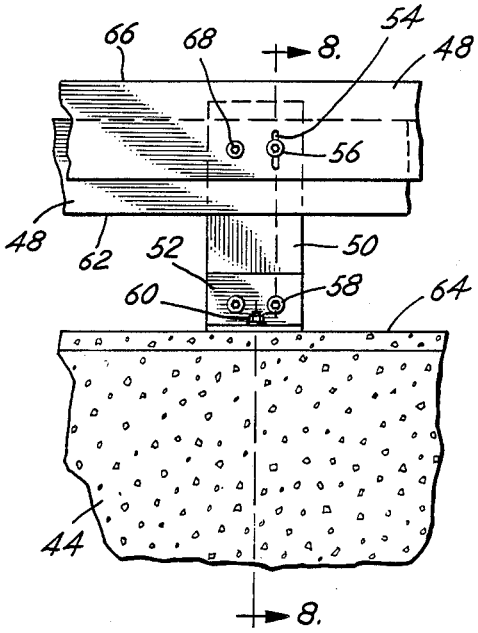
Fig. 12
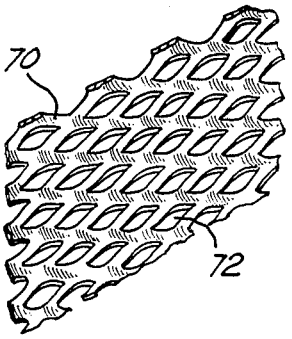
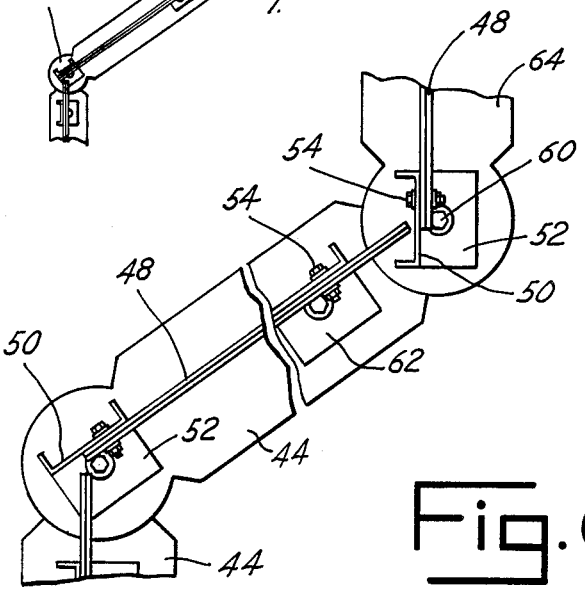
Fig. 6

Fig. 14
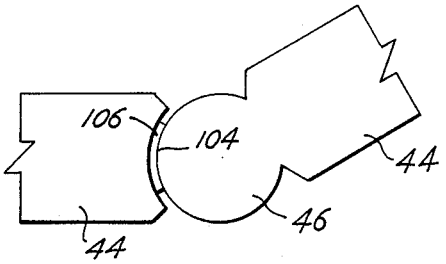
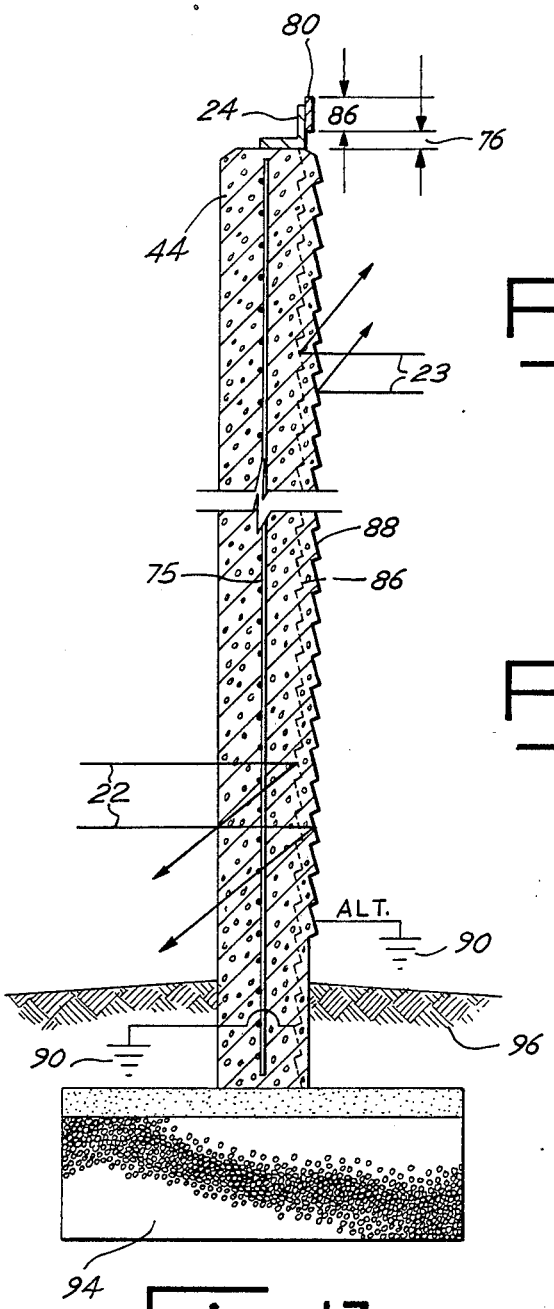
Fig. 13
Fig. 15
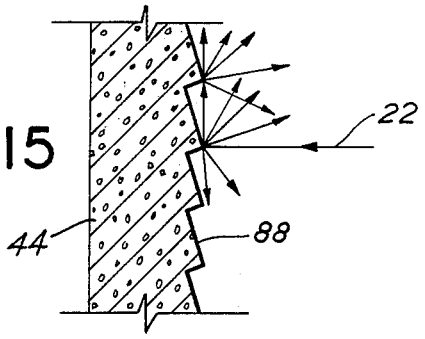
Fig. 16
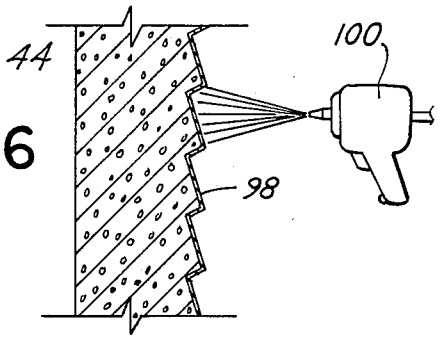
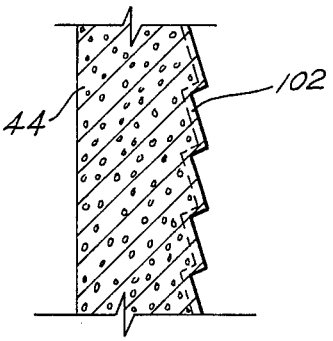
Fig. 17

MICROWAVE SHIELDING FOR SATELLITE EARTH STATIONS

BACKGROUND OF THE INVENTION

This invention relates to microwave antenna shielding, and more particularly relates to an improved protective wall system both for protecting satellite earth station reception antennas from interfering external sources of radiation, and for minimizing the discharge of stray microwave radiation departing from the vicinity of a satellite earth station antenna.

Antennas used to communicate with satellites by transmitting or receiving radio frequency (RF) signals in the microwave bands often must be shielded to operate effectively. When receiving signals from a satellite, antennas are highly susceptible to interference, usually in the range of 3.7 to 4.2 GHz (3.7 to 4.2 billion Hertz), derived from nearby RF sources or ground reflection. Such interference may result from direct transmitting sources, such as other satellite microwave communication antennas, or from the microwave portions of a telephone communication network. RF interference may also consist of RF signals reflected from nearby ground objects. In radar antennas, reflection from ground sources is known as "clutter." When transmitting signals, especially in a location having a relatively dense concentration of satellite communication stations, the antenna must be shielded to minimize escape of RF signals at ground level that could interfere with other antennas. Such outgoing signals are usually in the range of 5.9 to 6.5 GHz.

Prior antenna shield systems have adopted several approaches to interference and clutter elimination. Becuase microwave radiation is propagated along line of sight paths, the most common protection technique has been to install antennas in a location surrounded by solid, microwave absorbing or reflecting obstructions. Natural barriers such as hills, valley walls or quarry walls are effective in minimizing interference; where natural barriers are unavailable, earthen barriers or reflective shield fences must be constructed.

In densely populated or highly urbanized areas, natural barriers are often either unavailable or inconveniently located. Use of earthen berms also requires construction of substantial and usually relatively tall structures, which are costly, and in any event require more land area than is often available in urban locations. Accordingly, the most common method for eliminating RF interference or clutter in urban areas has been to construct shield walls or fences.

In their simplest form, shield walls or fences usually consist of a simple electrically conducting fence surrounding at least the sides of the antenna that are susceptible to RF interference, unwanted clutter, or radiation discharge. Such fences have frequently consisted of a metallic mesh fence with sufficiently small openings to block an acceptable portion of the unwanted radiation. In all mesh fences or reflectors, the size of the opening is a direct function of the RF signal that the system is designed to reflect. Generally, shield fences must produce at least a 30 dB reduction (known as "attenuation") in the radiation passing through the shield to be effective.

Like all electromagnetic radiation, RF radiation is diffracted when passed by a sharp or knife-like edge of RF reflective material. Thus, while RF interference reflecting fences can be constructed to adequately stop substantial quantities of microwave radiation from transmission through the wall or fence, a simple conducting wall or screen is normally inadequate to fully eliminate all RF interference or clutter, because the wall or fence usually acts as a knife edge that diffracts RF radiation into the vicinity of the antenna.

To eliminate diffraction problems, a variety of techniques or constructions have been employed. For example, shield walls or fences have been constructed with a large diameter rounded top to reduce the similarity of the shield wall top to a kife edge. Alternatively, walls have been constructed to extreme heights above the protected antennas to allow difraction of RF signals only to positions above the normally tall dish antenna.

Other, more complicated diffraction control systems exist in the prior art. U.S. Pat. No. 3,982,249, issued to Toman, discloses a combined diffraction control edge and radiation screen designed to reduce undesired ground reflection effects or other low angle radiation problems in a microwave signal transmission system. Similarly, Becker & Millett, *A Double-Slot Radar Fence for Increased Clutter Suppression*, IEEE Transactions on Antennaas and Propagation, Vol. AP-16 No. 1, Jan. 1968, discloses a system of two thin slots positioned on end parallel to the top edge of a shield fence. Ruze, *Radar Ground-Clutter Shields*, IEEE Proceedings, Vol. 54, No. 9, Sept. 1966, discloses serrated edges on the top of a radiation shield or fence to disperse diffracted RF signals. These and other systems are at least partially effective in attenuating diffracted RF interference.

Prior art radiation walls or fence constructions, while effective, have usually been costly, or difficult to construct and adjust, or both. Most wall or fence constructions must be of substantial height to effectively block interference in the vicinity of a large dish antenna. Such large walls or fences usually require extensive excavation to support, and may require construction of a complicated support structure to carry the expanse fine mesh necessary to reflect a sufficient portion of RF interference. Additionally, prior constructions for control of diffracted RF interference have usually been difificult to construct, or, as in the case of serrated edges, difficult to properly "tune" or adjust when installed. Moreover, prior shield systems have typically required constructions that are entirely custom designed for each shielded location; few if any of the components are modular or usuable in more than one location.

Accordingly, it is an object of this invention to provide an improved construction for shielding an antenna against RF interference.

It is a further object of this invention to provide a construction for shielding an antenna that both protects against transmission of RF signals through the shield and controls diffraction of RF signals across the top of the shield.

Another object of this invention is to provide an improved microwave wall or shield construction that may be quickly and inexpensively installed.

A further object of this invention is to provide a microwave wall or shield that utilizes standardized or modular parts and requires minimum custom design.

Still another object of this invention is to provide an improved microwave wall or shield construction that allows relatively easy adjustment of the diffraction control structure.

Those and other objects of the invention are achieved by providing a wall structure adapted to minimize radio frequency wave interference in the vicinity of an antenna. The wall is composed of a plurality of modular wall panels, each having a layer of electrically conductive materials that substantially block or reflect transmission of electromagnetic microwave signals. The wall structure includes a top structure creating thin generally horizontal gap in the conductive material at the wall's top, that acts to control diffraction over the wall. In the preferred embodiment, the layer of electrically conductive material is a mesh of expanded metal embedded in modular concrete panels, and the gap comprises the spece between the top of the mesh and a pair of vertically adjustable metal strips mounted on the wall.

These and other features of the invention are apparent from a study of the drawing figures and the following detailed description of the preferred embodiment.

BRIEF DESCRIPTION OF THE DRAWINGS

FIG. 5 is a top plan view of a segment of the preferred embodiment of a protective structure illustrating the layout of a modular wall system incorporating the diffraction control structure.

FIG. 6 is an enlarged plan view of a portion of the diffraction control structure illustrated in FIG. 5, illustrating the joints of the diffraction control construction.

FIG. 7 is a front elevational view of the support and adjustment structure for the diffraction control construction.

FIG. 12 is a perspective view illustrating the preferred embodiment of the conductive mesh embedded within the concrete wall modules.

FIG. 13 is a side cross-sectional view of an alternative embodiment of the invention illustrating an inclined step reflective layer.

FIG. 14 is a top elevational view of a wall module joint illustrating placement of a RF signal shielding gasket.

FIG. 15 is a side cross-sectional view of a wall module illustrating action of RF signals at the points of a conductive layer's steps.

FIG. 16 is a side cross-sectional view of a wall module illustrating preparation of an arc-sprayed conductive layer.

FIG. 17 is a side cross-sectional view of a wall module illustrating subsurface embedment of a metallized reflective blanket.

DETAILED DESCRIPTION OF THE PREFERRED EMBODIMENT

Figure 1:
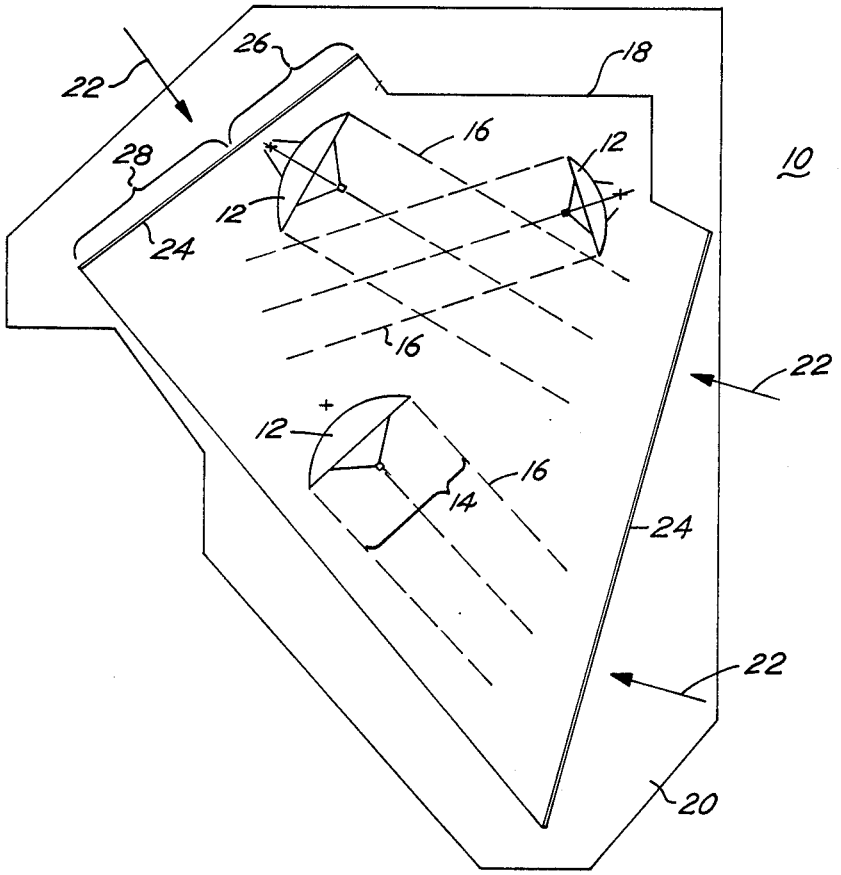
FIG. 1 is a plan view of a sample satellite antenna station providing an example layout of the antenna protection system.

Referring now to the illustrations and in particular to FIG. 1, the invention is intended for use with a conventional satellite antenna station 10. Shown illustrated in FIG. 1 are three dish antennas 12, however, an antenna station may have any number of antennas. Each antenna has a beam or aperture 14, and transmits microwave radiation 16 from a single linear direction.

In application, the invention as employed for a satellite antenna station includes a shield wall 18 surrounding the antenna station. In most applications, the antenna station 10 is erected on a prepared surface 20 having a configuration determined both by the outline of the shield wall 18 and the typography of the land upon which the antenna station is constructed. Normally, antenna stations 10 experience RF interference 22 from one or more principal directions. In the preferred embodiment of the invention, the shield wall 18 has top enhancements 24 only for that portion of the shield wall's perimeter facing the principal RF interference 22. In some instances, the diffraction top enhancements may be divided into multiple zones, each having different diffraction control characteristics. For example, a first zone 26 may be established to shield against diffraction effects of an antenna near the diffraction top enhancements and a second zone 28 in the same wall segment may be established to control diffraction of RF interference in the vicinity of an antenna positioned further away from the wall.

Figure 2:
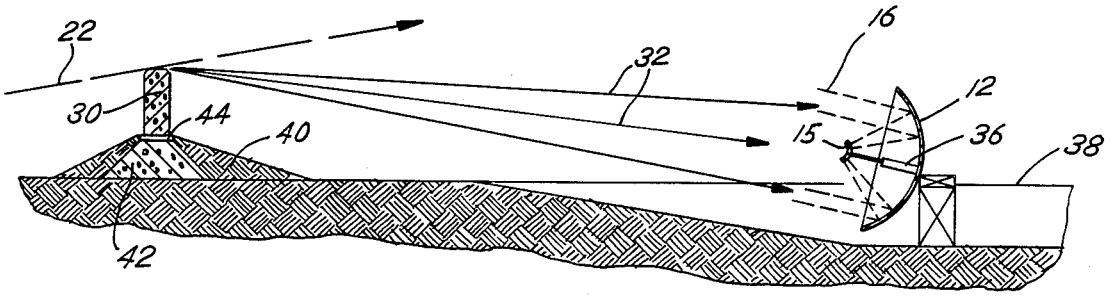
FIG. 2 is a side cross-sectional view of a portion of a conventional shield wall protecting a satellite communications antenna.

The particulars of the diffraction problem are illustrated in FIG. 2. A conventional shield wall 30 is normally placed in the vicinity of a dish antenna 12 to block incident RF interference. When the shield wall 30 is composed of material that reflects or blocks a substantial portion of the incident RF interference 22, the path of the incident RF interference 22 is partly diffracted 32, often to the vicinity of the dish antenna 12. Particular problems result when the diffracted RF interference 32 is incident upon the antenna subreflector 15 or feed horn 36.

In conventional satellite antenna stations, the dish antenna 12 is often positioned below the ground level 38 in an excavation. Additionally, the conventional shield wall is often placed on a berm 40, that can include a substantial foundation structure 42, often of concrete, positioned beneath a footing 44. While such structures may be employed with the invention to enhance the diffraction control and shielding effectiveness of the entire construction, the invention is also employable with minimum excavation and with neither a berm nor an extensive foundation structure placed beneath the wall.

Referring now to FIG. 5, the preferred embodiment of the invention is a set of prefabricated wall modules with diffraction control enhancements mounted on the top. Although the invention may be employed with any modular wall system, it is principally intended as an improvement on the wall system disclosed in U.S. Pat. No. 3,732,653 issued to Pickett for Barrier Structures and Connectors in Concrete Assemblies. The modular wall structure disclosed in the Pickett patent is currently marketed under the trademark FANWALL.

The preferred embodiment of the invention includes pre-cast concrete wall modules 44 connected at cylindrical joints 46. In the preferred embodiment, the wall modules 44 are composed of precast concrete with an embedded radiation shielding conductive material, described later in this specification. To control diffraction the preferred embodiment of the invention includes the diffraction top enhancements 24 positioned atop the wall modules 44.

Figure 8:
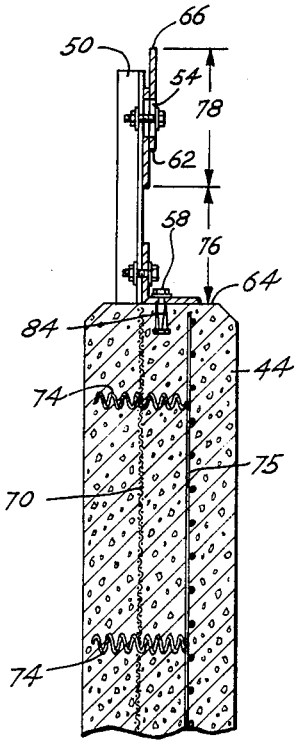
FIG. 8 is a side cross-section of the structure shown in FIG. 7, further illustrating the RF signal reflecting mesh.
Figure 10:
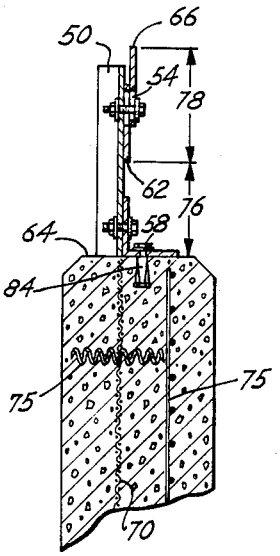
FIG. 10 is a side cross-sectional view similar to FIG. 8 showing an alternative positioning of the diffraction control system.
Figure 11:
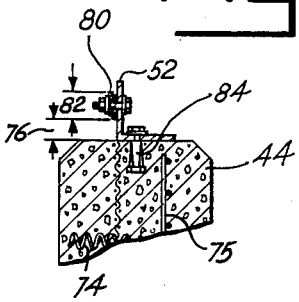
FIG. 11 is a side cross-sectional view similar to FIG. 8 showing a single strip diffraction system.

Referring now to FIG. 7, the preferred embodiment of the invention includes a pair of parallel conductive strips 48 mounted on a vertical channel beam 50. To support the diffraction top enhancements, a conventional clip angle 52 is fastened to the channel beam 50 and the wall module 44. The channel beam and clip angle are constructed of non-conductive material. Each strip 48 includes a vertical slot 54 corresponding to a bolt hole (not shown) in the channel beam 50. The conductive strips 48 are supported on the channel beam 50 by bolts 56 in each channel beam 50. Likewise, the channel beam 50 is secured to the clip angle 52 by bolts 58. The clip angle is secured to the wall module 44 by a bolt 60 connected to a wall embedded nut. As illustrated in FIGS. 8, 10, and 11, the clip angle 52 is secured by a bolt 58 threaded into an embedded nut 84.

Figure 9:
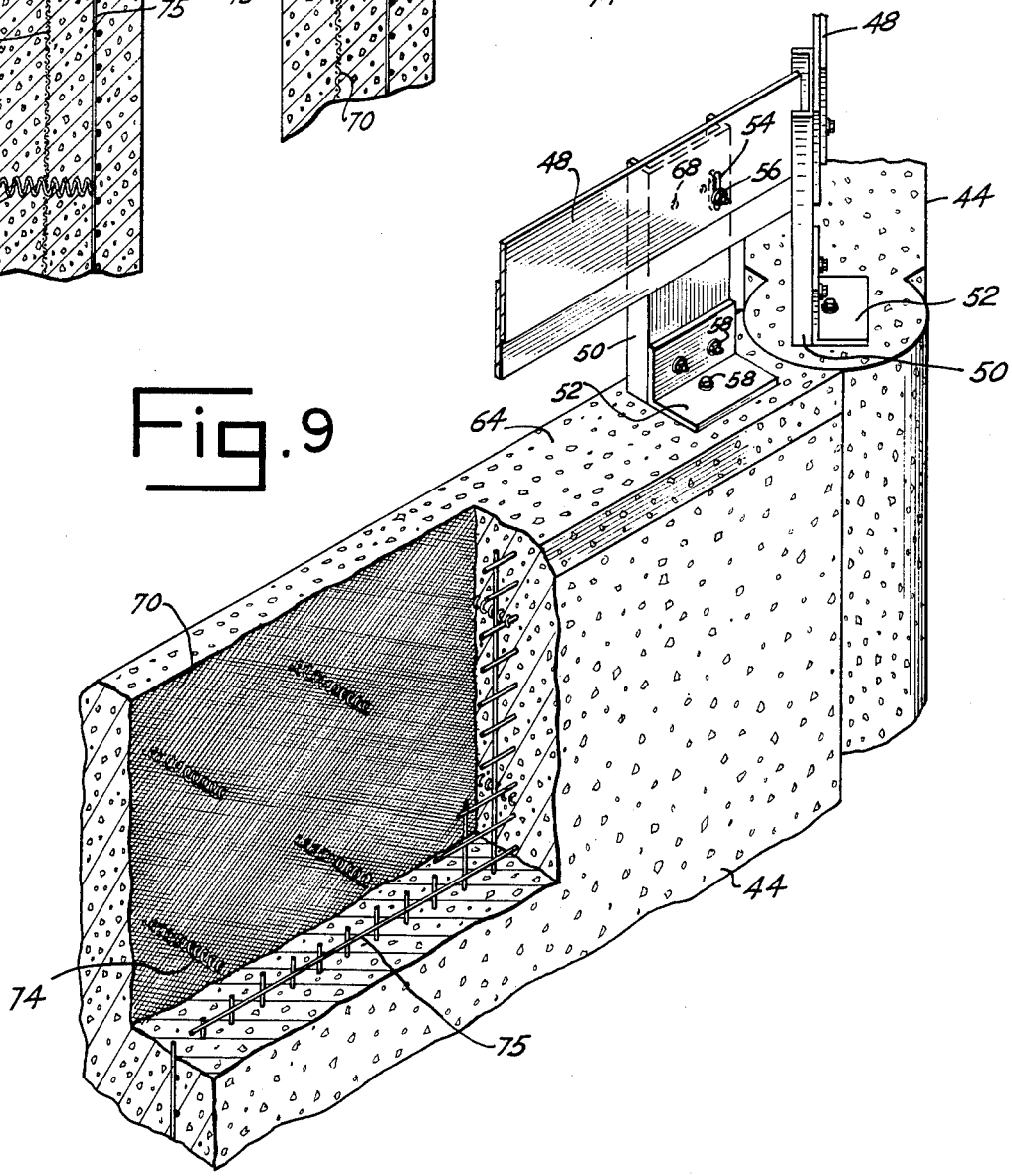
FIG. 9 is a perspective cutaway view of the invention showing the conductive mesh screen within concrete wall modules, and illustrating the joint structure for the diffraction control system.

Referring now to FIG. 9, after the strips 48 have been temporarily secured to the vertical channel beam 50, the exact position of the strips 48 may be adjusted by changing the position of the bolt 56 in the slot 54. Because two strips are used, the slot allows adjustment of both gap width 76 and strip width 82 by changing independently the position of the bottom 62 of the strips with respect to the top 64 of the wall modules, and the top 66 of the strips. Such adjustment is necessary to fine tune diffraction of the RF interference and thereby minimize field strength in the vicinity of the antenna aperature. Once the final adjustment of the exact position of both strips 48 has been made, an additional hole is drilled in the strips 48 corresponding to a predrilled hole in the channel beam 50. The additional hole positions a final bolt 68, which prevents movements of the strips during operation of the system.

Referring now to FIG. 6, details of the joints 46 are illustrated. The diffraction top enhancements 24 are normally designed to be a substantially continuous strip along the top of the wall module 44, such that little or no gap exists between each strip. The particular structure of the cylindrical joints of each module is not critical, so long as the joints allow module connection over approximately 180° of joint position. Connection details for the preferred embodiment of the invention are disclosed in U.S. Pat. No. 3,732,653, incorporated herein by reference.

Further details of a shield wall 44 with diffraction top enhancements 24 are illustrated in FIGS. 8 through 11. In the preferred embodiment, the invention includes a conductive layer 70 embedded within concrete modules 44, acting as an RF signal reflector. As illustrated in FIG. 12, the preferred embodiment of the invention utilizes a fine grained mesh of galvanized steel, usually known as "expanded metal." However, the conductive shield can consist of a variety of other microwave reflecting materials, including conventional wire mesh or screens. In an alternative embodiment, the conductive shield consists of a layer of conductive zinc sprayed upon either the inner or outer surface of the wall modules 44 (not shown). A mesh system such as expanded metal is preferred because it may be embedded within concrete to be relatively impervious to the effects of weather or other externally imposed forces. The conductive layer 70 is always grounded.

In the preferred embodiment, a mesh is used because the cavities 72 in the mesh allow bonding of the concrete throughout those cavities. To further enhance bonding of the mesh 70 to the modules 44, the panels should include a retention mechanism such as corkscrew shear ties 74 fitted through mesh cavities 72. Shear ties 74 may be any of the conventional means employed in the industry for securing mesh or related materials within a concrete cast structure. To maintain the strength of the wall modules, the preferred embodiment includes a network of conventional steel reinforcing bars 75. As is best illustrated in FIG. 9 and FIG. 6, the conductive strips 48 overlap the channel beam 50 through extension of the strips 48 into the channel of the vertical support channel beams 50.

As shown by a comparison of the FIGS. 8 and 10, the vertical strips 48 may be positioned at any of a variety of different widths, depending on the diffraction control desired. Of particular importance is controlling the gap width 76, between the top of the wall module 64 and the bottom of the conductive strips 48. Also important is the strip heighth 78, between the strip top 66 and the strip bottom 62. FIGS. 8 and 10 illustrates both conductive strips 48 with their vertical slots 54 positioned to correspond, however, such correspondence is not necessary and the vertical slots 54 may be positioned in whatever relative configuration is necessary to properly adjust the gap width 76 and the strip heighth 78.

In some embodiments of the diffraction top enhancements 24, a single conductive strip 80 may be utilized rather than the pair of conductive strips 48, as illustrated in FIG. 11. When a single conductive strip 80 is used, the strip width is constant, thereby preventing independent adjustment of gap width 76 and strip width 82. Use of a single strip 80 is usually most important when the strip width 82 and the gap width 76 are both intended to be relatively small.

Referring now to FIG. 13, an additional embodiment of the invention is disclosed. Like the alternatives disclosed in FIGS. 8 through 11, the alternative embodiment comprises a pre-cast concrete modular structure 44 with a diffraction top enhancement 24. The alternative embodiment also includes a conductive layer acting as a reflector, either as a mechanically-pierced and expanded internal layer 86 or as an alternative external layer 88. In either case, the conductive material layer is connected to a ground 90.

FIG. 13 also illustrates a possible alternative subsoil preparation. Generally, in this embodiment, the concrete module 44 rests on a sand leveling bed 92, which in turn rests on a foundation of compacted crushed stone 94. The sand leveling bed and crushed stone foundation are usually covered by a soil surcharge 96. The subsoil configuration disclosed for the alternative embodiment is also employable in the principal embodiment.

A significant feature of the alternative embodiment is the configuration of the conductive reflector layer 86 or 88. Generally, the layer is constructed with a "step" configuration, such that incident radiation 22 impinging on the external side of the shield (the side away from the antenna) is deflected downwardly toward the ground. Likewise, outgoing radiation 23 from the antenna impinging upon the shield wall is reflected upwardly, away from the antenna 12. The alternative embodiment of the invention is intended to include either a pair of conductive strips 48 or a single conductive strip 80, creating a gap 76 for a strip width 82. The method of mounting the conductive strips is the same as in the principal embodiment.

Two alternative means for constructing the planar reflector disclosed in the alternative embodiment are illustrated in FIGS. 16 and 17. As shown in FIG. 16, the inclined step reflector 88 can be prepared as an arc sprayed molten zinc coating 98 or as a resin product formulated with a high metal conductivity. In either instance, the conductive material is sprayed through use of any generally well-known implement 100.

As shown in FIG. 17, the conductive layer may be prepared as an inclined step planar reflector blanket 102 that is embedded within the subsurface of the wall module 44 and formed on the surface of the module 44. For concrete, the blanket is mixed with is zinc. If the wall module 44 is made of a different structure, aluminum should normally used. The metalized blanket is prepared by pouring a thin layer of metalized plastic concrete into a concrete form or mold having the inclined step shape. The balance of conventional concrete is then poured on top of the metalized blanket, resulting in a module 44 having an internal RF interference shield.

Referring now to FIG. 14, the cylindrical joints of the wall modules may also be constructed to prevent leakage of RF interference through the joints 46. A weather resistant closed-cell electroconductive foamed plastic gasket 104 may be applied to the concave vertical edge 106 of all panels, across the entire heighth of the joint. The electroconductive gasket then acts to eliminate leakage along the vertical joints of the structure.

It should be noted that, as shown in FIG. 15, the radio frequency signals 22 impinging upon an inclined step reflector, either internal or external, will be both reflected and diffracted at the point edges of the inclined step. The amount of such reflection and diffraction is normally insufficient to detrimentally affect the embodiment.

The design of the shielding system of this invention used at a particular antenna station is determined by the shielding effectiveness desired. Total shielding effectiveness is composed of two components: the efectiveness of the shield wall resulting from the grounded conducting layer that acts to reflect RF interference, and the ability of the wall top enhancements to control diffraction by producing destructive wave interference in the shield wall vicinity. Total shielding effectiveness is a result of both the effectiveness of the wall in preventing RF transmission, and the ability of top construction to control diffraction at the location of the antenna.

Shield effectiveness for the reflective wall is calculated by first evaluating the effectiveness of a solid wall of infinite extent. Such a wall is considered as one wide enough that diffraction around the side edges is negligible. For that wall, shielding effectiveness against RF transmission is governed by the general equation:

$$S.E. = A + R + B$$

where

S.E.=Shielding Effectiveness in dB

A=attenuation through the wall

R=reflection loss on the side of the wall upon which the RF wave impinges, and

B=the multiple reflection correction term

Attenuation is considered to be $$A = \alpha d$$

where $\alpha$=the attenuation rate in Nepers/meter (Np/m) when 1 Np=8.686 dB, and d=the wall thickness in meters.

The value of $\alpha$ is determined by $$\alpha = \sqrt{\omega\mu\sigma/2}$$

where $\omega = 2\pi f$, the angular velocity f=the wave frequency in Hertz $\mu$=the wall material electrical permeability in Henrys/meter (H/m), and $\sigma$=the electrical conductivity of the wall material in Siemens/meter.

Permeability is further calculated by $$\mu = \mu_O \mu_r$$

where $\mu_o$=the free space permeability, equaling $4\pi \times 10^{-7}$ H/m and $\mu_r$=the relative permeability.

Reflection loss is based upon the impedance discontinuity presented by the wall to the wave. Such reflection loss depends both on the wall's surface impedance, given by $$\eta_s = \sqrt{j\omega\mu/\sigma}$$

and on the wave impedance $\eta_o$. For both far away field conditions applicable to distant RF interference sources, and off-axis conditions applicable to antennas within the shield wall, $\eta_o$ is equal to 377 ohms. Reflection loss is then $$R = 20 \log_{10}\left\{\left(\frac{2\eta_s}{\eta_o + \eta_s}\right)\left(\frac{2\eta_o}{\eta_o + \eta_s}\right)\right\}$$

and the multiple reflection correction is $$B \simeq 20 \log_{10}\left|1 - 10\left(-\frac{A}{10}\right)(\text{Cos } 0.23A + j \text{ Sin } 0.23A)\right|$$

Applying the above equations yields an S.E. of approximately 1200 dB for 26 gauge steel (calculating relection loss for a conductivity equal to 0.1 that of copper). Such an extreme attenuation is excessive, and the materials required to produce a shield fence with that attenuation are unnecessarily expensive. Moreover, the RF interference produced by diffraction of signals about the wall top heavily negates such a wall's effectiveness despite the high attenuation produced. Minimum sufficient attenuation can be achieved by using wire mesh embedded in the wall, when at least 4 wire- /inch hardware cloth with at least #16 gauge wire is used.

Figure 3:
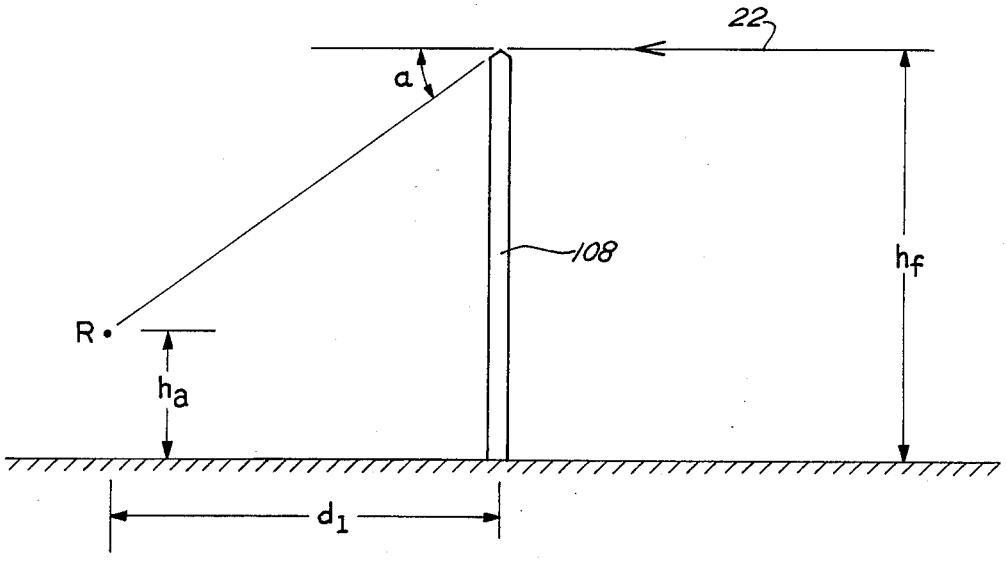
FIG. 3 is a side elevation of a shield wall illustrating knife edge diffraction.

Referring to FIG. 3, the diffraction resulting from a shield wall without a diffraction control structure is illustrated as a classical knife-edge diffraction problem. Incident radiation 22 diffracts at an angle $\alpha$. For a wall 108 of height $h_f$, approximating a knife edge, field strength E at a point R a height $h_a$ above the ground and distance $d_1$ from the wall 108 is reduced by an amount $$A(v,0)+A(0,\rho)+u(v\rho)\text{dB}$$

where $A(v_1 0)$ is the ordinary knife-edge diffraction loss and where the $A(0,\rho)$ and $u(v\rho)$ account for any finite radius of curvature of the top.

The diffraction strip technique functions as described by the Fresnel integrals x and y where x and y are the Fresnel integrals $$y = \int_0^v \sin \pi(x^2)/2\, dx$$

$$x = \int_0^v \cos \frac{\pi x^2}{2}\, dx$$

and $$v = \sqrt{2\alpha_1/\lambda}\ \tan \alpha, \text{ when } \lambda = \text{wave length}$$

Figure 4:
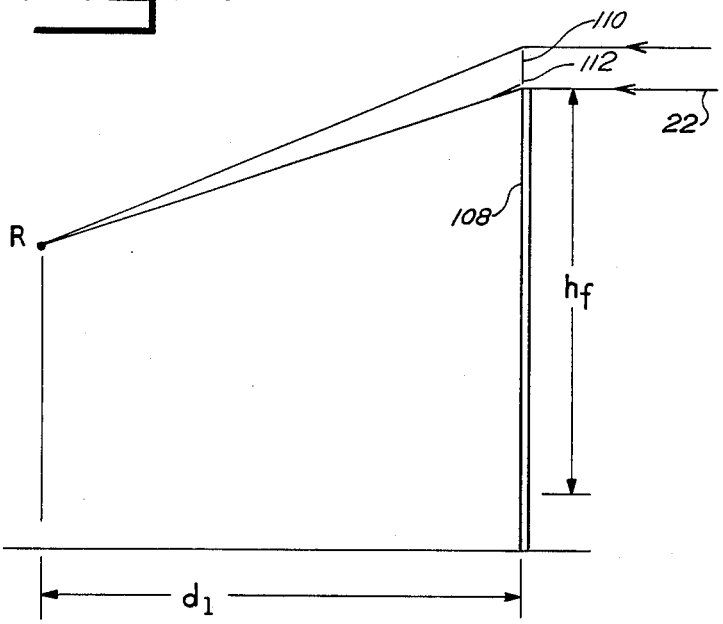
FIG. 4 is a diagnostic side view representation of the diffraction control structure employed by this invention.

Referring now to FIG. 4, diffraction is controlled by introducing a thin metallic strip 110 to a position slightly above the wall, leaving a thin gap 112 between the wall and the strip. Diffraction then results not only through the gap 112, but across the top of the strip 110. The waveform at position R is then the vector sum of the RF wave resulting from gap diffraction and the knife edge diffraction across strip 110. Both are calculated through use of the plot of the Fresnel integrals, with the gap width, the strip heighth and strip width chosen to cancel at position R.

The plot of (x,y) is known as the Cornu spiral and has been extensively tabulated. Using the Cornu spiral, field strength can be graphically calculated both for a simple knife edge, and for a thin slit positioned at the top of the wall. Use of the Cornu spiral to calculate diffracted wave field strength is disclosed in a variety of references, including Price et al., *Transmission Loss Predictions for Tropospheric Communication Circuits*, National Bureau of Standards Technical Note 101, as revised Jan. 1, 1967, which is hereby incorporated by reference, and Preikschat, *Screening Fences for Ground Reflection Reduction*, The Microwave Journal, Aug. 1964, pp. 46–50.

It is understood that numerous variations in the specific details disclosed can and will occur, and all are within the spirit and scope of the invention.

What is claimed is:

1. A construction for shielding an antenna for a satellite earth station against interfering microwave radio frequency radiation, comprising, in combination:

a wall structure having a top and interposed between the sources of interfering microwave radiation and the antenna, the wall structure having electrically conductive material screening the area defined by the wall's surface from RF radiation and substantially reflecting microwave radiation; and an adjustable RF diffractor made of conductive material and having one or more slits that are very small relative to the structure's height and defined by two or more parallel and slidably connected electrically conductive strips, adapted for vertical movement relative to each other, that may be moved independent of each other to vary the slit width and thereby create variable destructive interference and making the width of the separation of the strip from the top of the structure and the total width of the two strips independently adjustable, with the strips positioned on the top of the structure and along at least a portion of the wall structure, and with the strips supported by two or more columns mounted on the structure's top, with the columns having vertical slots for receiving fasteners and the parallel strips have corresponding openings and movably attached to the columns by fasteners extending through both the openings and slots, whereby undesirable microwave radiation is substantially reflected by the wall structure and diffraction across the top of the wall is adjustably controlled in the vicinity of the shielded item by varying the slit position and width.

2. A structure for minimizing radio frequency wave interference in the vicinity of an antenna for a satellite earth station, comprising, in combination:

a plurality of free standing modular wall panels, each having a top, connected by interlocking joints, with each panel having electrically conductive material positioned continuously throughout the panels and disposed to reflect interfering electromagnetic signals; and an adjustable diffraction structure of electrically conductive material mounted on the top of the panels to create a generally horizontal gap in the electrically conductive material, formed from a pair of parallel strips of electrically conductive material positioned horizontally along the top of at least a portion of the panels to create the gap located at the top of the panels, and with the gap being very thin with respect to the height of the panels and adjustable in width, with the strips vertically movable relative to each other, with the strips supported on the wall panels by two or more columns having vertical slots for receiving fasteners, and the parallel strips having corresponding openings, and with the strips being movably attached to the columns extending through both the openings and slots, whereby the size of the gap and total height of the wall may be independently adjusted by vertically moving one strip relative to the other and undesirable microwave radiation is substantially reflected by the electrically conductive layer in the panels, and diffraction across the top of the panels is controlled by the horizontal gap in the electrically conductive layer and the total height of the structure.

3. A construction for shielding an antenna for a satellite earth station against interfering microwave radio frequency radiation, comprising, in combination:

a concrete wall structure having a top and interposed between the source of interfering microwave radiation and the antenna, the wall structure having an electrically conductive, perforated metallic screen cast within the wall, screening the area defined by the wall's surface from RF radiation and substantially reflecting microwave radiation; and an adjustable RF diffractor made of conductive material and having one or more thin horizontal openings near the structure's top to create destructive interference with the diffractor positioned at the top of the wall structure along at least a portion of the wall structure, whereby undesirable microwave radiation is substantially reflected by the wall structure and diffraction across the top of the wall is adjustably controlled in the vicinity of the antenna by varying the opening width and location on the structure.

* * * * *